US006935331B2

(12) United States Patent
Farmer

(10) Patent No.: US 6,935,331 B2
(45) Date of Patent: Aug. 30, 2005

(54) PORTABLE TAR HEATING AND MELTING APPARATUS

(76) Inventor: Rodney Anthony Farmer, 116 S. Salem Ave., Sumter, SC (US) 29150

( * ) Notice: Subject to any disclaimer, the term of this patent is extended or adjusted under 35 U.S.C. 154(b) by 0 days.

(21) Appl. No.: 10/724,413

(22) Filed: Dec. 1, 2003

(65) Prior Publication Data

US 2005/0115558 A1 Jun. 2, 2005

(51) Int. Cl.[7] ..... E01C 19/45; F24H 9/02

(52) U.S. Cl. ..... 126/343.5 A; 126/373.1; 404/107

(58) Field of Search ..... 126/343.5 A, 353.5 R, 126/344, 345, 373.1, 374.1, 376.1; 404/107, 404/108, 111; 222/113, 146.2

(56) References Cited

U.S. PATENT DOCUMENTS 1,086,911 A * 2/1914 Gailor ..... 126/345
1,543,086 A * 6/1925 Baehr ..... 126/345
1,935,435 A * 11/1933 Cretors ..... 126/345
2,230,076 A 1/1941 Etnyre
2,997,040 A * 8/1961 Bold ..... 126/39 R
3,227,055 A * 1/1966 Glade ..... 404/107
3,995,616 A 12/1976 Schrader
4,033,328 A 7/1977 Lohman et al.
5,325,994 A * 7/1994 Mizialko et al. ..... 222/54
5,333,600 A * 8/1994 Fitzpatrick ..... 126/343.5 A
5,575,272 A * 11/1996 Byrne ..... 126/343.5 A
6,439,806 B1 * 8/2002 Dillingham ..... 404/95

FOREIGN PATENT DOCUMENTS

GB 2 094 468 A * 9/1982

* cited by examiner

*Primary Examiner*—Josiah C. Cocks

(57) ABSTRACT

A portable tar kettle includes a steel containment body mounted on wheels and having a handle projecting therefrom with the handle including an integral gas line that interconnects to an external propane tank and internally registers with a gas burner located within the containment body. Disposed within the containment body is a tar cooking vessel that holds the tar, and other material, to be heated and melted. The tar cooking vessel includes a lid with an integral temperature gauge. When the tar is appropriately heated and melted, the tar cooking vessel can be removed and carried to the roof of the structure, and this process can be repeated as many times as necessary to effect roof repair and maintenance.

9 Claims, 2 Drawing Sheets

PORTABLE TAR HEATING AND MELTING APPARATUS

FIELD OF THE INVENTION

The present invention pertains to portable heating units, and more particularly pertains to tar and asphalt melting and heating units.

BACKGROUND OF THE INVENTION

Tars of various derivations, such as coal tar, wood tar, and gas tar, have numerous uses in, for example, roofings, coverings, paints, the impregnation and preservation of wood, adhesives and binders, road coverings and compositions, and asphalt materials. In addition, tar is a source of chemicals like phenol, benzene and toluene.

Among the most common uses of tar is for sealing the roof so that the interior of the dwelling, be it a residential or commercial structure, remains impervious to the infiltration and seepage of water or moisture. The tar is used in conjunction with roof sheathing, roofing paper and felt and shingles to completely seal the roof and maintain the integrity of the interior dwelling rooms and spaces.

However, over the passage of time, and as part of the normal break down and deterioration experienced in materials and structures, roofs develops fissures, cracks and leaks that require maintenance and repair; and part of the roof maintenance and repair involves the selective re-application of tar to those parts or portions of the roof undergoing break down and deterioration. Oftentimes the leaks and cracks are of a minor dimension but still sufficient to impair the integrity of the roof, and thus require only a small and selective application of tar thereon. While a building or roofing contractor is not needed in such instances, some means or structure is still needed to melt and heat the tar and/or asphalt for application to the surface or area requiring the maintenance and repair.

Thus, the prior art discloses several tar and asphalt melting kettles such as the Schrader patent (U.S. Pat. No. 3,995,616). Schrader discloses a towable asphalt kettle that includes a heating and melting chamber and a closure disposed over the chamber having chute portions terminating with openings for loading tar chunks into the chamber. Each chute portion has a hinged door for closing off the chute portion from the closure to minimize the escape of gas or asphalt and to seal the closure from the external environment upon the occurrence of a pressure differential.

The Lehman et al. patent (U.S. Pat. No. 4,033,328) discloses a towable tar-melting kettle that includes a vat in which an immersion tube unit is placed, and the immersion tube unit contains the burners and conduit used to heat the chunks of tar. A double rotating cylinder registers with the immersion tube unit that permits chunks of tar to be placed into the rotating cylinder for deposition into the vat without exposing the melting tar to the environment and preventing the tar from splashing outside of the vat.

Despite the ingenuity of the above devices, they are large, unwieldy and generally unnecessary for the repairs and maintenance required of typical home and office owners.

SUMMARY OF THE INVENTION

The present invention comprehends a portable tar kettle primarily for do-it-yourselfers, and includes a portable steel containment body mounted on wheels and having a projecting handle and an intergral gas hose that can be connected to a propane tank. A gas burner is internally located at the bottom of the steel body and spaced-apart vent holes are located about the upper rim of the steel containment body. Disposed within the containment body is a five-gallon tin tar cooking vessel wherein the tar and other material is heated and melted. The cooking vessel includes a pivotal handle that allows the user to insert and remove the cooking vessel from the containment body and a removable lid for sealing the cooking vessel. The lid also includes a temperature gauge and a handle specifically for removing the lid from the cooking vessel.

It is an objective of the present invention to provide a portable tar kettle that has a fast recovery time and a high cooking time utilizing only a singe burner.

It is another objective of the present invention to provide a portable tar kettle that is lightweight and portable and capable of transport in the trunk of a car or the bed of a pickup truck.

It is yet another objective of the present invention to provide a portable tar kettle that can be used by both professional contractors and roofers and for do-it-yourself projects.

Still yet another objective of the present invention is to provide a portable tar kettle that is particularly well suited for use with flat or low pitched roofs that need intermittent applications of tar to maintain their integrity.

These and other objects, features, and advantages will become apparent to one skilled in the art upon a perusal of the following detailed description, the accompanying drawings and the appended claims.

DETAILED DESCRIPTION OF THE PREFERRED EMBODIMENT

Figure 1:
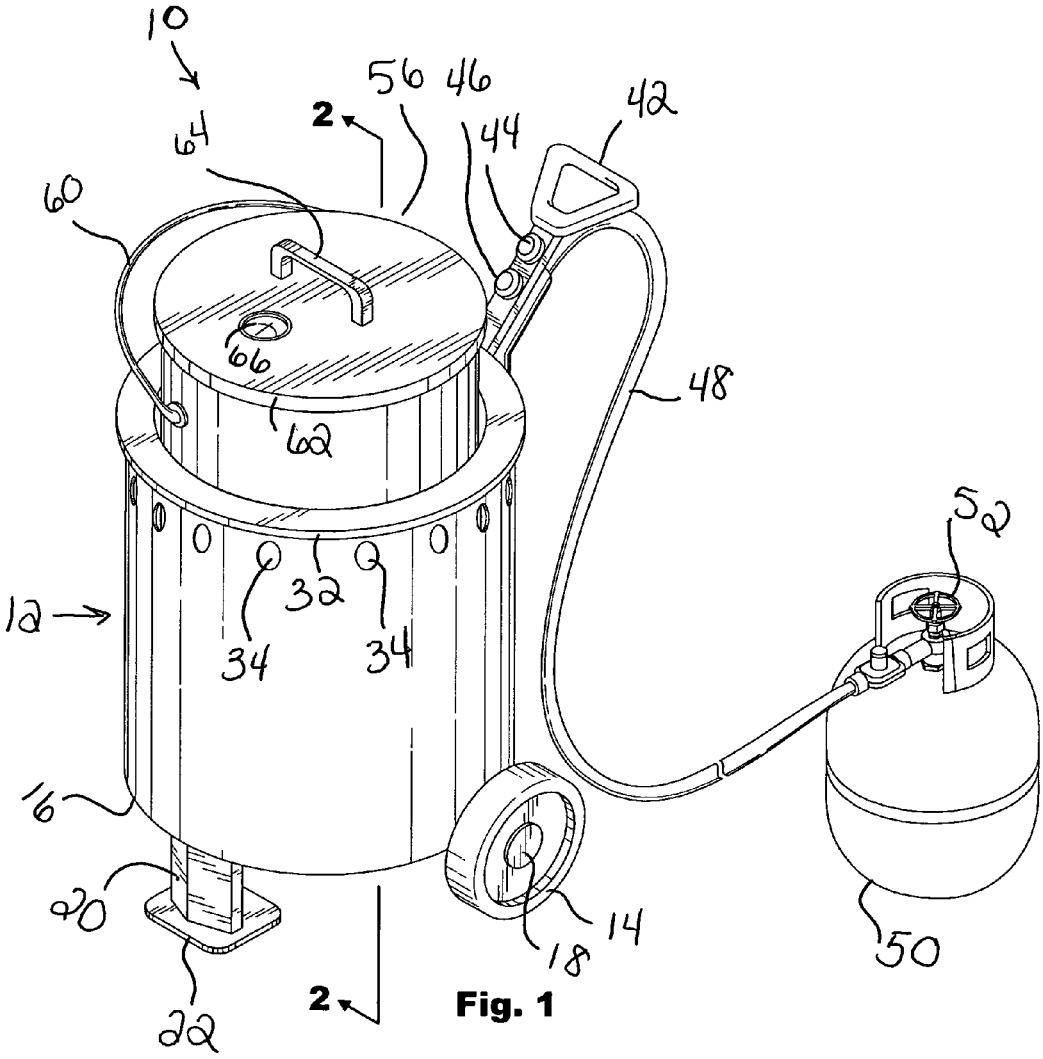
FIG. 1 is a perspective view of the portable tar heating and melting apparatus.
Figure 2:
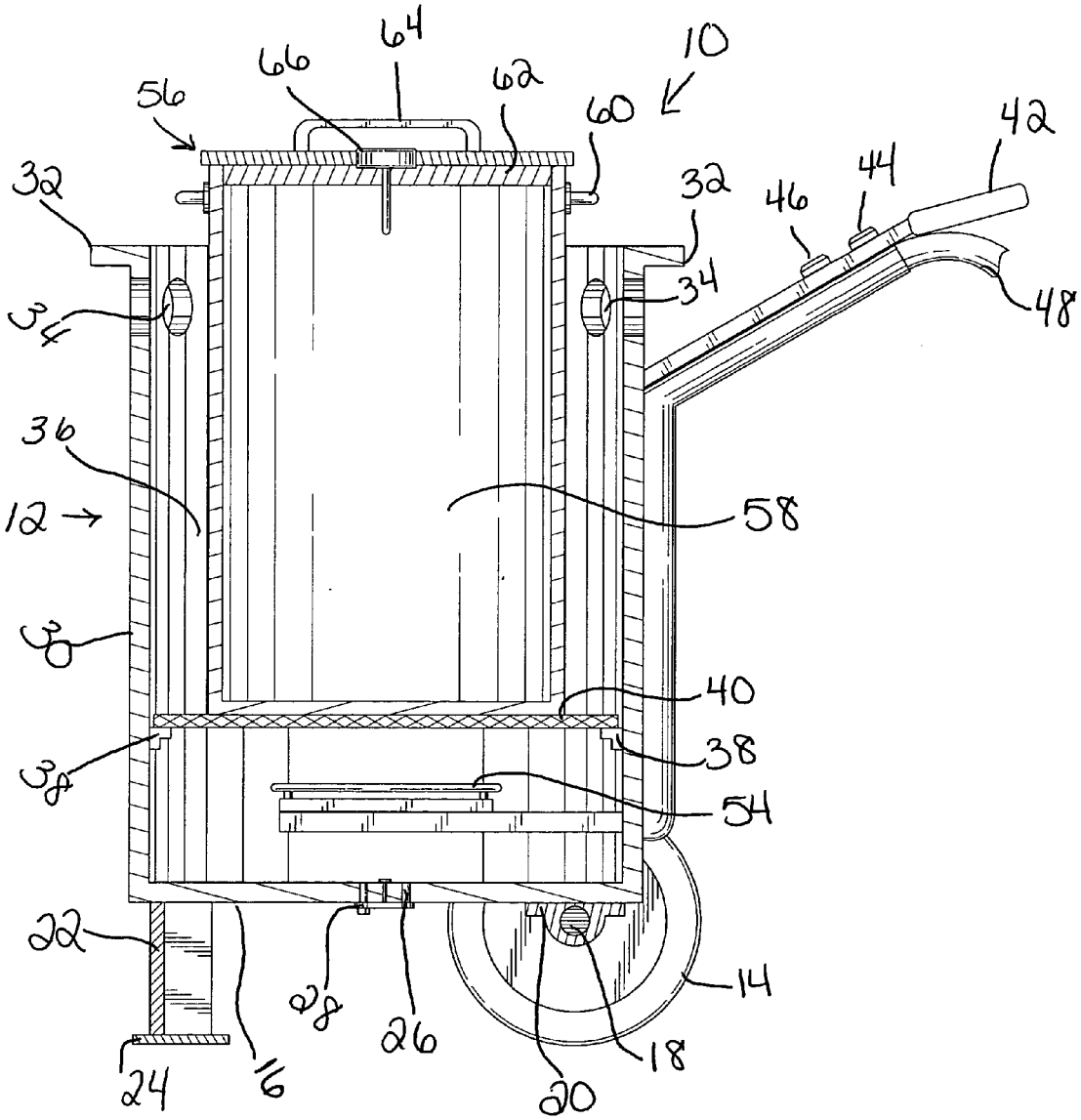
FIG. 2 is a sectioned elevational view of the portable tar heating and melting apparatus shown in FIG. 1 taken along lines 2—2 of FIG. 1.

Illustrated in FIGS. 1 and 2 is an apparatus for heating and melting tar and ancillary material for roof repair and maintenance. Specifically, the apparatus is a portable hot pot tar kettle 10 primarily for do-it-yourself roof repair and maintenance on flat or low pitched roofs that require small patch jobs, and that can be accomplished without the involvement of a professional roofing or building contractor. The portable tar kettle 10 of the present invention is designed to be lightweight and mobile for transport in the trunk of an automotive vehicle or the bed of a pickup truck.

The portable tar kettle 10 includes a cylindrical steel containment body 12 that is transportable and positionable by a pair of wheels 14 (composed of durable, hard rubber) that are mounted to the underside or bottom 16 of the containment body 12 on axles 18 journaled to brackets or bearing support members 20. In addition, to maintain the containment body 12 in a stable, upright position, a leg 22 is mounted to the containment body bottom 16 and extends downwardly therefrom. The leg 22 terminates with a flat foot 24 that extends perpendicular to the leg 22 for contact with the ground surface. Centrally located on the containment bottom 16 is a clean-out or drain vent or aperture 26 and a removably securable plug 28.

As shown in FIGS. 1 and 2, the containment body 12 includes a cylindrical sidewall 30 that terminates with an upper projecting ring 32. Located subjacent to the ring 32 are a plurality of spaced-apart containment body venting apertures 34 for air and heat exhaust and ventilation during the heating and melting process. The containment body 12 defines an interior cavity 36, and mounted at the lower portion of the interior surface of the sidewall 30 is an inner annular ledge 38. The inner ledge 38 supports a cooking platform 40 that can be removed from the cavity 36 of the containment body 12 for cleaning, repair and replacement. While the dimensions for the containment body 12 can vary, preferred dimensions are that the sidewall 30 of the containment body 12 has a thickness of ½ inch, an outside diameter of 14 inches and an inside diameter of 13 inches. In addition, the containment body 12 would be 16 and ½ inches tall and weigh approximately 100 pounds, and the containment body 12 would be manufactured from an appropriate gauge steel.

As shown in FIGS. 1 and 2, attached to the containment body 12, and projecting upwardly therefrom, is a handle 42 (preferably of steel) for maneuvering and positioning the tar kettle 10 by the user. The handle 42 includes an on/off valve 44 for regulating gas flow and a sparker 46 for ignition purposes. Integrally interconnected to the handle 42, and extending for a length of at least 25 feet therefrom, is a flexible gas line or hose 48. The gas hose 48 is adapted for interconnection to a standard propane tank 50 having a gas regulator 52 for controlling gas discharge and flow from the tank 50. A portion of the gas hose 48 extends internally through the handle 42 and the sidewall 30 of the containment body 12 for registration with a gas burner 54. The gas burner 54 is mounted to the interior surface of the containment sidewall 30 and projects centrally into the cavity 36 of the containment body 12 beneath the cooking platform 40.

Illustrated in FIGS. 1 and 2 is the structure in which the tar and other material is actually heated and melted for application to the repair site. Specifically, a cylindrical tar cooking vessel 56 is disposed within the cavity 36 and supported on the cooking platform 40 wherein the vessel 56 is filled to the desired level and capacity so that the heating and melting process can commence. The vessel 56 is preferably of tin composition and of a five gallon capacity. In addition, as shown in FIG. 2, there is a slight clearance between the sidewall 30 of the containment body 12 and the cooking vessel 56 sidewall to permit heat and air exhaustion, dissipation and ventilation; and to allow for the insertion and removal of the tar cooking vessel 56 into the cavity 36 and from the cavity 36 of the containment body 12. The tar cooking vessel 56 includes an interior chamber 58 wherein the tar, and other material such as small rocks, are placed for heating and melting, and a pivotal handle 60 used for lifting the cooking vessel 56 out of the containment body 12 or sliding the cooking vessel 56 into the cavity 36 of the containment body 12. Also, the tar cooking vessel 56 includes a lid 62 for sealing the chamber 58 of the tar cooking vessel 56, a handle 64 for removing the lid 62, and an integral temperature gauge 66 for displaying the temperature of the tar in the chamber 58 of the tar cooking vessel 56.

One recommended manner of using the mobile tar heating and melting apparatus 10 of the present invention is as follows. First, the gas hose 48 should be securely interconnected to the propane tank 50. Then the gas regulator 52 can be turned on with the setting carefully adjusted wherein the on/off valve 44 on the handle 42 can be turned on. The sparker 46 should then be contacted several times until the gas burner 54 ignites, and then the on/off gas valve 44 on the handle 42 can be further adjusted for controlling the gas burner 54. The chamber 58 of the cooking vessel 56 can be filled with approximately one or two inches of small rocks by placing them at the bottom of the chamber 58 of the tar cooking vessel 56; and then the tar can be placed in the chamber 58 of the vessel 56. When the temperature gauge 66 indicates that the tar is at the proper temperature, and thus has attained the appropriate melting point and proper consistency, the individual can lift the cooking vessel 56 out of the cavity 36 of the containment body 12 by the pivotal handle 60. The individual can then carry the tar cooking vessel 56 to the roof whereupon the tar can be applied to the patch or area needing repair. This process would be repeated until the particular job is finished. In addition, tars of various colors can be added as desired during the heating phase and before the material fully liquifies.

While a preferred embodiment of the invention as been illustrated and described, it should be understood that numerous modifications and alterations could be made and still come within the ambit of the appended claims as the invention should not be limited to the specifics of this embodiment but as defined by the appended claims.

I claim:

1. A portable tar heating and melting apparatus, comprising:

a cylindrical-shaped containment body, and the containment body being further characterized by a cylindrical bottom and a sidewall upwardly extending from the bottom;

the sidewall defining an upwardly opening cavity that is closed off by the cylindrical bottom;

an annular ledge disposed within the cavity adjacent the cylindrical bottom and which is mounted to the sidewall;

a perforated cooking platform for removable placement upon the annular ledge;

a tar cooking vessel having a chamber for receiving tar and other materials, the tar cooking vessel capable of removable insertion within the cavity of the containment body and upon the cooking platform;

the tar cooking vessel having an outside diameter that is less than the inside diameter of the sidewall of the containment body to allow for clearance between the cooking vessel and the sidewall of the containment body;

a gas burner disposed within the cavity of the containment body and spaced beneath the annular ledge and cooking platform and above the cylindrical bottom for providing the heat energy that heats and melts the tar and other materials contained within the cooking vessel; and whereupon after the tar and other materials have attained the desired consistency the cooking vessel can be manually removed from the containment body and carried to the application site.

2. The portable tar heating and melting apparatus of claim 1 further comprising a handle mounted to the containment body and extending upwardly therefrom for positioning and maneuvering the tar heating and melting apparatus.

3. The portable tar heating and melting apparatus of claim 2 wherein the sidewall of the containment body includes an annular upper end.

4. The portable tar heating and melting apparatus of claim 3 wherein the upper end includes a plurality of spaced-apart venting apertures that allow air and heat to pass therethrough during the heating and melting of the tar and other material within the cooking vessel.

5. The portable tar heating and melting apparatus of claim 4 wherein the cooking vessel includes a handle pivotally mounted thereon for permitting the manual insertion of the cooking vessel within the cavity of the containment body and upon the cooking platform and for removal therefrom after the tar and other material has attained the desired consistency through the heating and melting process.

6. A portable tar heating and cooking apparatus, comprising:

a cylindrical-shaped containment body with the containment body further characterized by having a cylindrical flat bottom and a sidewall upwardly extending from the bottom;

the sidewall defining an upwardly opening cavity that is closed off by the cylindrical bottom;

an annular ledge disposed within the cavity adjacent the cylindrical bottom and which is mounted to the sidewall;

a perforated cooking platform for removable placement upon the annular ledge;

a tar cooking vessel having a chamber for receiving therein tar and other material, the tar cooking vessel capable of removable insertion within the cavity of the containment body and upon the cooking platform;

the tar cooking vessel projecting above the sidewall when the tar cooking vessel is disposed within the containment body and the tar cooking vessel having an outside diameter that is less than the inside diameter of the sidewall of the containment body to provide clearance between the tar cooking vessel and the sidewall of the containment body;

a cooking vessel handle pivotally mounted to the cooking vessel to allow for the manual insertion of the tar cooking vessel within the cavity of the containment body and upon the cooking platform and for the removal of the tar cooking vessel therefrom;

a gas burner projecting within the cavity of the containment body and spaced beneath the annular ledge and the cooking platform and above the cylindrical bottom for providing the heat energy that heats and melts the tar and other material within the tar cooking vessel to the desired consistency; and whereupon after the tar and other material has attained the desired consistency the cooking vessel can be manually removed from the containment body and carried to the application site.

7. The portable tar heating and cooking apparatus of claim 6 further comprising a handle mounted to the containment body and extending upwardly therefrom for manual positioning and maneuvering of the tar heating and cooking apparatus.

8. The portable tar heating and cooking apparatus of claim 7 wherein the sidewall of the containment body includes an annular upper end.

9. The portable tar heating and cooking apparatus of claim 8 wherein the upper end of the sidewall includes a plurality of spaced-apart venting apertures that allow air and heat to pass therethrough during the process of heating and melting the tar and other material within the cooking vessel.

* * * * *